US009837230B2

(12) United States Patent
Bujotzek et al.

(10) Patent No.: US 9,837,230 B2
(45) Date of Patent: Dec. 5, 2017

(54) HIGH VOLTAGE PUFFER BREAKER AND A CIRCUIT BREAKER UNIT COMPRISING SUCH A PUFFER BREAKER

(71) Applicant: ABB Schweiz AG, Baden (CH)

(72) Inventors: Markus Bujotzek, Zürich (CH); Angelos Garyfallos, Baden (CH); Philipp Simka, Cham (CH); Emmanouil Panousis, Baden (CH); Nitesh Ranjan, Wettingen (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/367,990

(22) Filed: Dec. 2, 2016

(65) Prior Publication Data

US 2017/0084412 A1 Mar. 23, 2017

Related U.S. Application Data

(63) Continuation of application No. PCT/EP2014/061383, filed on Jun. 2, 2014.

(51) Int. Cl.
*H01H 33/666* (2006.01)
*H01H 33/88* (2006.01)
(Continued)

(52) U.S. Cl.
CPC ..... *H01H 33/882* (2013.01); *H01H 1/385* (2013.01); *H01H 33/53* (2013.01);
(Continued)

(58) Field of Classification Search
CPC ..... H01H 33/91; H01H 2033/908; H01H 33/901; H01H 33/7023; H01H 33/74;
(Continued)

(56) References Cited

U.S. PATENT DOCUMENTS 4,430,535 A 2/1984 Berg et al.
5,902,978 A 5/1999 Zehnder et al.
(Continued)

FOREIGN PATENT DOCUMENTS

DE 2653077 A1 6/1977
FR 2352386 A1 12/1977
FR 2733086 A1 10/1996

OTHER PUBLICATIONS

European Patent Office, International Search Report & Written Opinion issued in corresponding Application No. PCT/EP2014/061383, dated Feb. 11, 2015, 8 pp.

*Primary Examiner* — Truc Nguyen
(74) *Attorney, Agent, or Firm* — Taft Stettinius & Hollister LLP

(57) ABSTRACT

Gas-insulated high voltage puffer breaker comprising a puffer unit with a movable piston running in a puffer cylinder and delimiting a puffer volume. A piston and a first contact member are attached to a piston stem. A piston and a first contact member are attached to a piston stem. An electric arc is extinguishable in an arcing zone when the first contact member moves from a first position to a second position. The puffer volume is fluidly connected to a gas nozzle by a gas channel such that the puffer volume comprises the gas channel as well as a portion of the puffer cylinder. The gas channel is provided radially outside of the puffer cylinder between a puffer cylinder wall delimiting the puffer cylinder and a wall structure of the puffer unit.

19 Claims, 6 Drawing Sheets

(51) Int. Cl.
*H01H 1/38* (2006.01)
*H01H 33/90* (2006.01)
*H01H 33/91* (2006.01)
*H01H 33/53* (2006.01)
*H01H 33/70* (2006.01)

(52) U.S. Cl.
CPC ..... *H01H 33/666* (2013.01); *H01H 33/6661* (2013.01); *H01H 33/7023* (2013.01); *H01H 33/90* (2013.01); *H01H 33/91* (2013.01)

(58) Field of Classification Search
CPC ..... H01H 33/905; H01H 2033/906; H01H 33/7076; H01H 33/88; H01H 2033/566; H01H 33/22; H01H 2033/567; H01H 2033/888; H01H 33/56
See application file for complete search history.

(56) References Cited

U.S. PATENT DOCUMENTS 5,977,502 A * 11/1999 Mizoguchi ..... H01H 33/901 218/43
6,646,850 B1 * 11/2003 Bergmann ..... H01H 33/7015 218/53
2001/0025827 A1 * 10/2001 Hunger ..... H01H 33/904 218/43
2002/0000425 A1 * 1/2002 Nauche ..... H01H 33/901 218/43
2003/0094436 A1 * 5/2003 Andou ..... H01H 33/56 218/43
2003/0094437 A1 * 5/2003 Hirose ..... H01H 33/7076 218/57
2006/0151438 A1 * 7/2006 Urai ..... H01H 33/904 218/57
2007/0272659 A1 * 11/2007 Saxl ..... H01H 33/24 218/149
2008/0006609 A1 * 1/2008 Schoenemann ..... H01H 33/74 218/157
2009/0008367 A1 * 1/2009 Kriegel ..... H01H 33/7061 218/62
2009/0261071 A1 * 10/2009 Nufer ..... H01H 33/901 218/81
2010/0219161 A1 * 9/2010 Seeger ..... H01H 33/74 218/51
2013/0020285 A1 * 1/2013 Schiffbauer ..... H01H 33/91 218/47
2013/0168357 A1 * 7/2013 Yaginuma ..... H01H 33/08 218/57
2014/0190938 A1 * 7/2014 Tsukushi ..... H01H 33/905 218/63
2015/0060411 A1 * 3/2015 Yamashita ..... H01H 33/903 218/158

* cited by examiner

HIGH VOLTAGE PUFFER BREAKER AND A CIRCUIT BREAKER UNIT COMPRISING SUCH A PUFFER BREAKER

TECHNICAL FIELD

The invention relates to a puffer breaker to be used in a gas-insulated switch-gear as well as to a circuit breaker unit comprising such a puffer breaker. Moreover the invention relates to a use of such a puffer breaker for interrupting a current in a high voltage system, in particular an HVDC system.

BACKGROUND ART

In prior art literature several types of puffer breakers are known.

FR2733086A1 is an example of a puffer breaker having a first contact member and a second contact member that form a separable interruption current path being separated to a separable nominal current path. A drive is connected to a puffer cylinder such that the latter is movable relative to a fixed piston in order to feed an amount of stored gas in the puffer volume within the puffer cylinder to a nozzle.

A representative of a second type of puffer breakers is known from FR2352386A1. The general idea of this document is to promote a puffer breaker for comparatively short strokes. Such a short stroke will lead to a way lower mass flow of gas since the diameter of the piston is traditionally determined by the given nominal contact system. For enabling short strokes and overcoming the problem of low mass flow, FR2352386A1 promotes arranging a plurality of compression volumes. Hence said puffer breaker comprises a puffer cylinder having several pistons attached to a common piston stem including a hollow pin forming the first contact member such that several puffer volumes are formed. When the puffer volumes are squeezed the gas trapped therein is allowed to escape via ports into the interior of the tubular piston stem up to the pin tip where they come in contact with the electric arc.

There are switching situations where not only the travelling speed of a movable first contact member relative to a second contact member are decisive but also the time to accelerate the first contact member to the maximum travelling speed becomes important. Both representatives of the first and second type have in common that they have a limited pertinence for mastering that task.

GENERAL DISCLOSURE OF THE INVENTION

The object to be solved by the present invention is therefore to provide a puffer breaker whose first contact member can be accelerated faster than in known puffer breakers.

The above-mentioned object is solved by the gas-insulated high voltage puffer breaker according to claim 1 in that the inertia of the movable parts of the puffer breaker is lowered compared to known puffer breakers.

It was found that achieving a lowermost inertia of the movable parts in a puffer breaker contributes most to higher acceleration and deceleration values independent of the actual drive. Expressed in other words higher acceleration values are achievable by many kind of drives such as spring-operated drives or drives employing an electromagnetic repelling force (Lorentz force principle), for example. Hence the present invention provides a solution for speeding-up the interruption process from trip to the moment in time where the first movable contact member is put into motion or movement by a drive of the puffer breaker without sacrifying the interruption capacity in comparison to known breakers dedicated to comparable power ratings.

The term 'high voltage' is understood in this application as an operating voltage or nominal voltage according to DIN VDE of at least a 1000 Volts (1 kV).

A basic embodiment of the gas-insulated high voltage puffer breaker comprises a) a puffer unit with a piston that is movably arranged in a puffer cylinder such that a puffer volume is delimited, b) a first contact member being movably arranged relative to a second contact member of the circuit breaker such that a current path is established in a first position of the first contact member and that said current path is interrupted in an arcing zone once the first contact member is moved to a second position of the first contact member, wherein the first contact member is connected to a drive by a piston stem, c) a nozzle for laterally, i.e. circumferentially (with respect to the switching axis) delimiting the arcing zone of the puffer breaker.

The puffer volume is fluidly connected to the nozzle by a gas channel. The blanket term 'nozzle' used hereinafter is understood in fact as a nozzle system that may comprise more than one single nozzle, if required. The piston and the first contact member are attached to the piston stem. The puffer volume comprises the gas channel as well as a portion of the puffer cylinder. The gas channel and said cylinder portion are fluidly connected to one another by a port such that a gas flowing in a first direction from the portion of the puffer cylinder is redirected via the gas channel in a second direction towards the nozzle once the first contact member is moved from the first position towards the second position. In other words the puffer breaker is closed if the first contact member is in its first position and is fully open if the first contact member is in its second position. The term port shall not be understood in that it needs to be one single orifice. Rather shall it be understood functionally in that it fluidly connects the puffer volume within the portion of the puffer cylinder with the dead volume in the gas channel which is achievable by a plurality of ports forming such a fluid connection.

Moreover, the gas channel is provided radially outside of the puffer cylinder between a puffer cylinder wall delimiting the puffer cylinder and a wall structure of the puffer unit. Most likely said wall structure will be an intermediate structure of the breaker unit and not of its metal clad enclosure.

As a result the puffer chamber is subdivided by the puffer cylinder wall into the following two sub-compartments:

a portion of the puffer cylinder, i.e. a volume extending in the direction of movement of the piston and delimited by the movable piston and the stationary wall of the puffer cylinder, and the gas channel.

In known puffer breakers the puffer volume comprises also a puffer cylinder compartment and gas channels of smaller cross-section leading to the nozzle.

The volume in the gas channel is also referred to as dead volume. Said dead volume is preferably way smaller than the maximal portion of the puffer cylinder. The size of the dead volume has to meet two conditions:

First, the size of the gas channel is not too large such that there will be no substantial gas pressure at the nozzle;

Second, the size of the gas channel is not too small, i.e. the gap shall not be chosen to be too narrow because the formation of a maximal gas pressure a gas velocity of about sonic has to be avoided within the gas channel as those requirements are required exclusively at the nozzle. A gas channel of too small a size would cause a pressure loss within the gas channel leading to insufficient pressure at the nozzle and thus to a delayed arc extinction, if any.

A possible ratio of the size of the dead volume in the gas channel to the maximal portion of the puffer cylinder is about 1:10, for example.

In comparison to classic puffer breakers where the dead volume is located within the puffer cylinder the relocation of the dead volume to a place outside the puffer cylinder allows for a higher design freedom of the present puffer breaker. This because the cross-section of the dead volume and thus inevitably also its length in the direction of the switching axis is no longer dictated by the cross-section of the interior of the puffer cylinder.

Moreover providing the gas outside the puffer cylinder allows for a basic design of the piston stem and the piston that is advantageous in turn of an economic manufacturability.

In a most basic embodiment the piston stem may have a circular cross-section when seen in a direction of the switching axis. However other cross-sections shapes are possible, too.

A minimal cross-section of the first contact member, for example a pin, is given by a current density in the interruption path leading through the first and second contact member. Thus the geometric decoupling of the dead volume from the puffer cylinder allows for a pin-shaped and thus most basic piston stem/first contact member design since the latter does not act as a gas channel portion such as taught by FR2352386B1, for example. Hence designing the piston stem/first contact member of the present invention to a minimal diameter and thus minimal cross-section becomes possible. It is evident that the inertia of such a piston stem/first contact member of the present invention will be lower than the inertia of a piston stem/first contact member according to FR2352386B1, for example, because a wall thickness of a piston stem cannot drop lower than a given threshold that is defined by mechanical requirements. Expressed in more details the outer diameter of the piston stem/first contact member of an embodiment according to FR2352386B1 is not only dependent on the cross-section of the gas channel in the interior of the piston stem/first contact member required for achieving a sufficient pressure and gas flow but also on a minimal wall thickness of the hollow piston stem/first contact member that is required to meet mechanical minimum standards in view of rigidity as well as on stability since the cross-section must be able to withstand the mechanical impacts of the piston on the hollow piston stem/first contact member in a durable and reliable manner. As a result the inertia of a piston stem/first contact member of an embodiment according to FR2352386B1 will always be higher than the one of a piston stem/first contact member according to the present invention.

Furthermore, having pin-shaped piston stem/first contact members with a most-basic cross-section as those according the present invention is advantageous compared to hollow ones such as promoted by FR2352386B1 as the flow rate of the blowing gas is not determined and limited by the dimension and the cross-section of the piston stem any longer.

Depending on the embodiment of the puffer breaker the gas channels may be integrated at least partially in the chamber housing of the puffer breaker A first advantage of the present invention resides in that one could realize the same interruption performance with a weaker drive compared to a drive of the same type employed nowadays. The term 'weak drive' is understood as a drive of the same type but of lower performance in terms of kinetic energy involved. Employing a weak drive rather than a more powerful drive is advantageous in that weaker drives are far less expensive such the overall cost share of the drive will have a lower share to the overall costs of a circuit breaker unit.

A second advantage resides in that the interruption times and the arcing times can be reduced. Reduced interruption times and arcing times are advantageous for AC as well as for DC applications. Lower arcing times in AC applications are desired because the amount of destruction caused by the electric arc is smaller compared to a known interruption by a known circuit breaker and the same ratings.

Reduced interruption times are of particular interest to HVDC applications where the interruption process has to be accomplished within a few milliseconds only, i.e. about 5-40 times faster than with common AC puffer breaker for the same voltage level. Hereinafter the term HVDC is understood as a direct current with a voltage of at least 40 kV, in particular more than 80 kV, for example 320 kV.

When striving for a lowermost inertia the number and mass of the parts to be moved by the drive has to be lowered as much as possible. Thus it is advantageous that the first contact member and the piston stem are movably arranged to be movable along a switching axis. This is contrary to many prior art puffer breakers such as those of FR2733086A1, for example, where the piston stem is fixedly attached to the puffer cylinder whereas the piston remains stationary.

In an embodiment providing for particular low inertia the first movable contact is rigidly connected to a piston of an electromagnetic repulsive force drive such as a Thomson coil drive by a pull rod. That way no extra drive gear is required which adds to the inertia and causes friction which hampers a fast acceleration. If the piston stem and the pull rod and the piston of the electromagnetic repulsive drive are arranged along a switching axis a particularly lean drive chain is achievable.

A compact puffer drive is achievable if the portion of the puffer cylinder is arranged centrally, i.e. rotationally symmetric with respect to the switching axis, wherein the puffer volume in the portion of the puffer cylinder is delimited radially inwards with respect to the switching axis by the piston stem.

A short overall length of the puffer unit in the direction of a linear switching axis is achievable if the gas channel is arranged in between the puffer cylinder wall and the wall structure of the puffer unit such that an annular radial gap is formed.

Such an arrangement is also advantageous in that is allows for maximum design freedom in view of a stroke length of the piston and thus the choice of the kind of actual drive selected for powering the piston stem. Depending on the stroke length of the piston the diameter of the piston can be selected for achieving a predetermined puffer volume.

By keeping the gas channel stationary with respect to the interruption zone the movable parts of the puffer unit formed by the piston and the piston stem do not need to serve as gas guiding structures. That way their geometry can be kept as basic, i.e. simple as possible which is beneficial to a low inertia, too.

Maximal interruption values are achievable if the gas blow is maximal in the nozzle. That requires a maximum gas pressure at the gas nozzle which is achievable if an overall cross section of the annular radial gap of the puffer breaker is smallest at an end of the gas channel discharging into the nozzle. In other words, the smallest cross section of gas channel between the portion of the puffer cylinder and the gas channel including the ports is at the gas channel outlet to the nozzle. Hence the cross-section at the gas channel outlet to the nozzle is preferably smaller than overall cross-section of the ports.

Guiding the pressurized gas from the puffer volume radially into the arcing zone allows for breaking the electric arc in more than one axial interruption area, e.g. in two axial interruption areas at an axial interruption point each. That way the arc interruption of such an embodiment will be considerably higher than that of a puffer breaker such as disclosed in FR2352386B1, for example.

Even in case of puffer units having a short overall length in the direction of a linear switching axis a fair design freedom for the dead volume formed by the gas channel is achievable if the port is arranged at a remote first end of the puffer volume with respect to the interruption zone. By arranging the port at the far end side of the puffer cylinder with respect to the arcing zone the dead volume for the gas within the gas channel can be selected without affecting the overall length of the puffer unit because the dead volume is not arranged in front of the leading end of the piston any longer such as in known prior art devices.

If required the ports can be arranged at the fixed head wall portion at the far end side of the puffer cylinder with respect to the arcing zone.

If a short overall length in the direction of a linear switching axis is required the port is arranged in the puffer cylinder wall extending circumferentially about the portion of the puffer cylinder with respect to the switching axis. Expressed in other terms, the port or the ports extend radially outwards with respect to the switching axis.

Homogeneous gas distribution values in the gas channel is achievable if the port comprises a plurality of gas outlets leading from the portion of the puffer cylinder to the gas channel. If possible it is advantageous to arrange the plurality of gas outlets evenly distributed in the circumferential direction at the inner wall of the puffer cylinder. Homogeneous gas distribution values are particularly advantageous if the end of the gas channel discharging into the nozzle is of annular shape.

A further volume of the puffer cylinder is located on an opposite side of the piston with regards to the portion of the puffer cylinder when seen in the direction of the switching axis. It is advantageous to connected said further volume fluidly to an exhaust volume provided outside the wall structure of the puffer unit by way of at least one exhaust port. In case of a an annular cross-section of the gas channel said at least one exhaust port is penetrating the gas channel locally such that the gas in the gas channel is allowed to flow around or flow by the at least one exhaust port. Depending on the embodiment it may be advantageous to provide for a plurality of exhaust ports, for example sleeve-like exhaust ports that are evenly distributed in the circumferential direction with respect to the switching axis at an end of the puffer cylinder proximal to the arcing zone, i.e. opposite of the far end of the puffer cylinder.

The at least one exhaust port prevents the formation of a suction force if the piston moves from a position at the proximal end to a position at the far end of the puffer cylinder if the first contact member moves from its first to its second position, respectively. As a result the movement of the piston in the puffer cylinder is not hampered by a gas underpressure in the beginning of movement of the piston stem in an acceleration stage of the movement.

Moreover the cross-section of the at least one exhaust port is selected such that the piston movement is essentially not hampered by the formation of a gas cushion in the puffer cylinder in the further volume at the rear side of the piston when moving the first contact member from the second position back to its first position.

In addition the at least one exhaust port forms a path for the exhaust of hot gas produced during arcing in the interruption process and thus ensures for proper flow conditions in the gas nozzle.

The degree of free movement of the piston stem is further increased if the piston is dimensioned relative to the portion of the puffer cylinder such that no bodily radial seal element in between the piston and the interior wall of the puffer cylinder is required. Compared to known puffer breakers whose shell surfaces of the pistons are sealed against the puffer cylinder wall by way of a sealing gasket a sufficient degree of gas sealing is achievable in case of fast accelerated pistons in that just a minimal mechanical play is allowed in between the shell surfaces of the piston and the interior wall of the puffer cylinder. That way no friction caused by a sealing hampers the movement of the piston in the puffer cylinder in the beginning of movement of the piston stem in an acceleration stage of the movement.

If a back travel of the piston in the puffer cylinder shall be prevented or lowered to a minimum compared to known puffer breakers the puffer breaker can be further improved in that an annular groove is arranged on an interior side of the puffer cylinder wall proximate or adjacent to the port such that a diameter of the interior side of the puffer cylinder is larger than an outer diameter of the piston. Said annular groove starts at about an axial position reached by a trailing end of the piston when the first contact member is approaching the second position in an operating state of the puffer breaker. In other words, the annular groove starts at about an axial position the trailing end of the puffer piston reaches when the first contact member is approaching the second position. At that moment in time the arc interruption process in the arcing zone is concluded and having a maximal gas pressure at the nozzle is not required at that moment of interruption process any longer.

The larger the acceleration the larger the back travel of the piston may become an issue because a movement of the piston in the opposite direction inevitably brings the first contact member closer to the fixed second contact member. This is undesired as it promotes re-arcing which has to be avoided because it jeopardizes the success of the current interruption.

The annular groove extends in the direction of the switching axis over a distance being larger than a thickness of the piston at (the interior side of) the puffer cylinder. The annular groove is dimensioned such that gas from the portion of the puffer cylinder is allowed to escape to the exhaust via said annular groove to a rear side of the piston along an escape path when the first contact member is approaching the second position.

That way the energy of the gas trapped in the portion of the puffer cylinder belonging to the pressure volume is allowed to escape because an overall gas resistance in the escape path is smaller than an overall gas resistance in the gas channel at this position of the piston in an operating state of the puffer breaker.

If the whole drive chain between the first contact member, the piston stem with the piston and the actual drive has a low inertia it is particularly suitable for being powered by a drive employing the Lorentz force principle because such a drive concept enables achieving high acceleration values. Provided that the drive chain is quite rigid in the direction of the switching axis the electromagnetic repulsive force can be produced by the drive for moving the piston stem. A main advantage of such an electromagnetic repulsive drive, e.g. a Thomson coil drive resides in that it provides for a fast release of energy and thus contributes to achieving maximal acceleration values compared to known drives such as spring-operated drives, for example. As mentioned before fast acceleration values enable shortest interruption times which is advantageous not only in HVDC applications but also in AC applications.

A further advantage of employing an electromagnetic repulsive drive resides in that the stroke length can be dimensioned independent of gas flow and drive.

A full or maximal stroke distance is chosen for meeting the dielectrics requirements, i.e. the ability to withstand the voltage. If required, it further provides for sufficient room for arranging a double nozzle arrangement, if needed.

When employing an electromagnetic repulsive drive, e.g. a Thomson coil drive the electromagnetic force acts on the drive's moving part only during a comparatively short distance, for example a mere 10 mm. After the piston of the Thomson coil drive has traveled over said short distance during the acceleration phase it has reached such a high velocity that it can travel along the switching axis about a further distance because the mass of the movable parts has been put in motion. Said further distance can be varied depending to the design requirements.

Depending on the design requirements at least one of the piston and the first contact member are at least partially integrated into the piston stem. As a result the piston and the piston stem can form a single body or be manufactured separately and connected thereafter. The only important thing is that the piston is fixed relative to the piston stem in the direction of the piston stem forming also the switching axis.

If the puffer unit, the drive and the pull rod are arranged in a common gas-tight enclosure no bodily seal elements (gaskets) are hampering the free movement of the pull rod and thus the drive chain which contributes further to achieving highest acceleration values. Expressed in other terms, such a solution requires only a minimal amount of energy required from a drive for moving the piston stem.

The above-mentioned advantageous puffer breaker can be connected electrically in series with a vacuum interrupter to form a circuit breaker unit. Such a unit is particularly suitable for interrupting a high voltage direct current because the vacuum interrupter can take over the voltage drop over the circuit breaker unit in an initial stage of the interruption process until the puffer breaker is ready to take over the voltage drop over the circuit breaker unit in a subsequent stage of the interruption process. Said subsequent stage is about to begin at the time the first contact member is approaching its second position such that a sufficient and reliable insulation distance in between the first contact member and the second contact member of the puffer breaker is achievable.

Depending on the requirements the first contact member and the second contact member of the puffer breaker can be arranged in an interruption current path provided in addition to a nominal current contact system. Alternatively the first contact member and/or the second contact member of the puffer breaker may be integrated into the nominal contact path, where needed.

If it is required that the movable contact members of the vacuum interrupter and the puffer breaker can be put into motion independently of one another in time or at a delay in time it may be advantageous to dedicate a further drive to the vacuum interrupter. Said further drive can also produce an electromagnetic repulsive force for moving a movable contact member of the vacuum interrupter from a closed position into an open position, if required.

If no time delay is required for accelerating both the first contact member of the puffer breaker and the movable contact member of the vacuum interrupter the vacuum interrupter and the puffer breaker may share a drive. That way the movable contact member of the vacuum interrupter can be moved by the same drive like the first contact member of the puffer breaker simultaneously.

All above-mentioned embodiments of the high voltage puffer breakers and circuit breaker units may be used for interrupting a current in a high voltage DC system. Said HVDC system can be formed by a point to point HVDC link, a multi terminal HVDC system comprising at least three stations whereof one station is provided just for tapping a HVDC current, or a so-called HVDC grid comprising a plurality of power senders and receivers.

BRIEF DESCRIPTION OF THE DRAWINGS

The description makes reference to the annexed drawings, which are schematically showing in FIG. 1 a schematic longitudinal section through a first embodiment of the puffer breaker, where a first contact member is in its first position.

In the drawings identical parts, currents and voltages are designated by identical reference characters.

WAYS OF WORKING THE INVENTION

Figure 1:
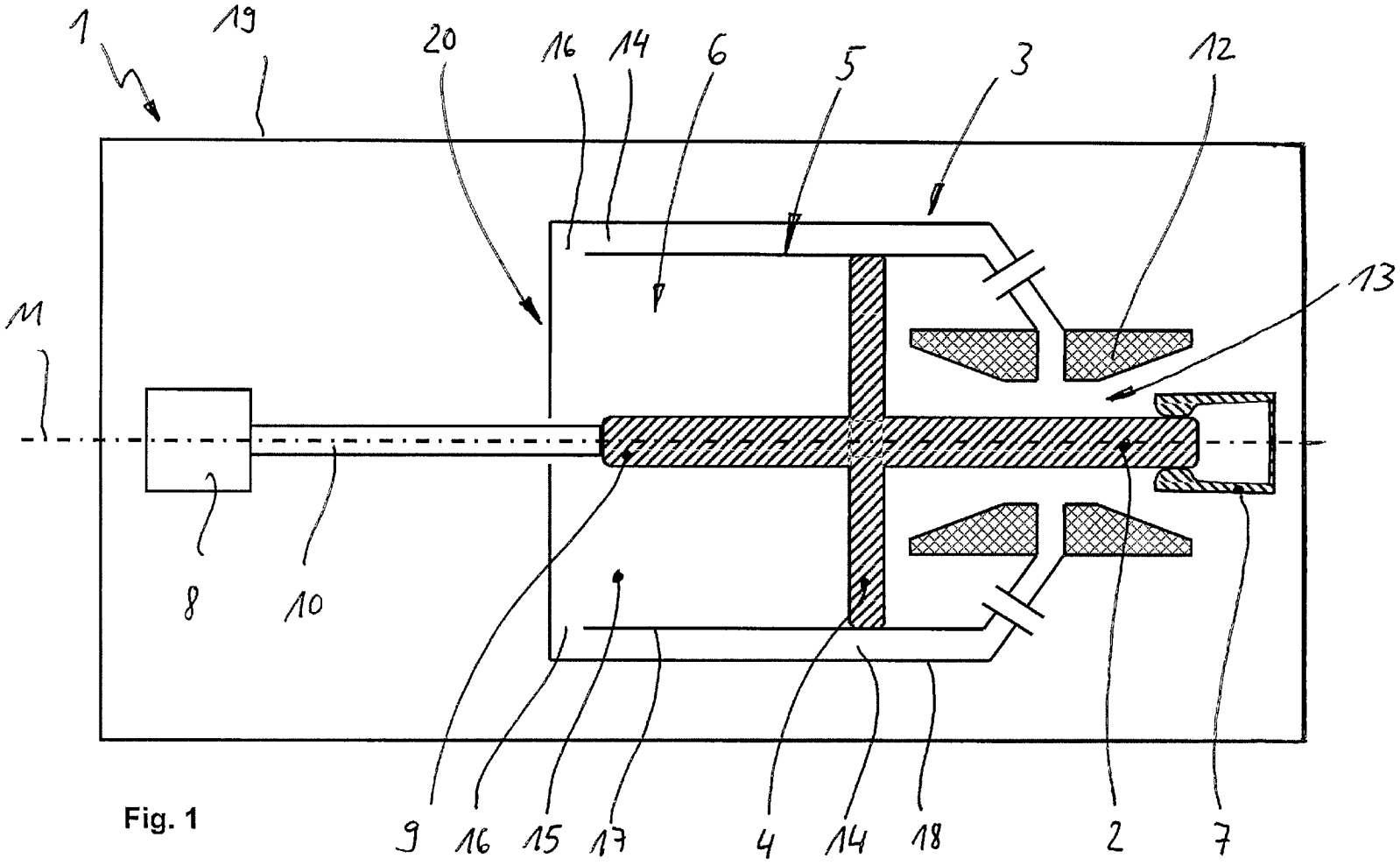

In FIG. 1 a first embodiment of the puffer breaker 1, where a first contact member 2 is in its first position. Said gas-insulated high voltage puffer breaker 1 has a puffer unit 3 with a piston 4 that is movably arranged in a puffer cylinder 5 such that a puffer volume 6 is delimited. The first contact member 2 is movably arranged relative to a tulip-shaped second contact member 7 such that a current path is established. The power connection of the second contact member 7 has not been illustrated in FIG. 1 and following as it is known to the skilled reader. The first contact member 2 is connected to a drive 8 by a piston stem 9 and a pull rod 10 in order to form a gearless and rigid mechanical chain along switching axis 11.

The puffer unit 3 comprises a nozzle 12 for laterally delimiting an arcing zone 13 of the puffer breaker 1 in that it extends about the switching axis 11.

The puffer volume 6 is fluidly connected to the nozzle 12 and the arcing zone 13 by a gas channel 14. Said gas channel has an annular cross-section when seen in the direction of the switching axis 11.

The piston 4 and the first contact member 2 are attached to the piston stem 9. The puffer volume 6 comprises the volume of the gas channel 14 as well as a portion 15 of the puffer cylinder 5, wherein the gas channel 14 and said cylinder portion 15 are fluidly connected to one another by a port 16 such that a gas flowing in a first direction from the portion 15 of the puffer cylinder is redirected via the gas channel 14 in a second direction towards the nozzle 12 once the first contact member 2 is moved from the first position towards the second position.

The port 16 is arranged at a remote first end 20 of the puffer volume or puffer cylinder with respect to the interruption zone/arcing zone 13. The port 16 comprises a plurality of gas outlets leading from the portion 15 of the puffer cylinder 5 to the gas channel 14.

The gas channel 14 is provided radially outside of the puffer cylinder 5 between a cylindrical puffer cylinder wall 17 delimiting the puffer cylinder and a wall structure 18 of the puffer unit 3. The puffer cylinder wall 17 is a structural element of the puffer breaker and not to be confused with an inner surface of the puffer cylinder wall 17 addressed in more detail later on.

The puffer unit 3, the drive 8 and the pull rod 10 are arranged in a common gas-tight enclosure 19 shown in a very simplified manner in FIG. 1 and subsequent figures.

Figure 2:
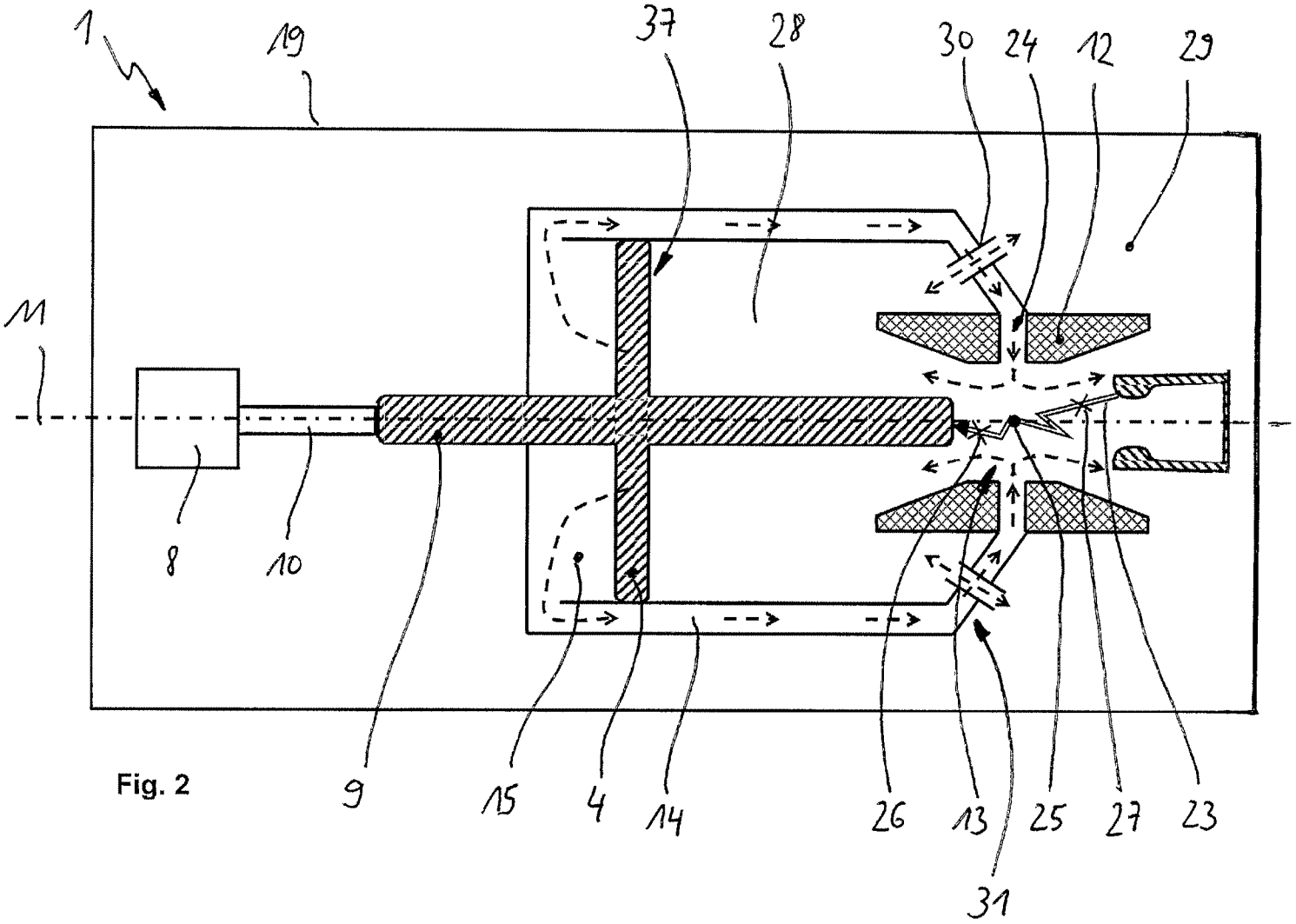
FIG. 2 a schematic longitudinal section through a first embodiment of the puffer breaker of FIG. 1, wherein the first contact member is in an intermediate position between the first position and a second position.

FIG. 2 shows the puffer breaker 1 of FIG. 1 but where the first contact member 2 is in an intermediate position between the first position and a second position. Compared to FIG. 1 the piston stem 9 with the first contact member 2 and the piston 4 are drawn further to the left in FIG. 2. At this intermediate position the gas pressure at the gas channel outlet to the nozzle is maximal and an electric arc 23 extending in between the tip ends of the first contact member 2 and the second contact member 7 is about to be extinguished by a gas flow 24 emerging into the arcing zone 13 from the gas channel 14. The gas channel has an annular shape when discharging into the nozzle 12. Said gas flow 24 is caused by the movement of the puffer piston 4 squeezing the gas out of the portion 15 of the puffer cylinder 5 through the gas channel 14. In the arcing zone the gas flow 24 causes a stagnation point 25 indicated by a bullet point and two radial interruption areas at an axial interruption point 26, 27 indicated by a cross-mark each. Gas movements in the gas channel 14 and in the portion 15 of the puffer cylinder 5 are indicated by dashed arrows.

As can be seen in FIG. 2 a portion of the gas flow 24 emerging of the nozzle 12 is directed partly towards the exhaust 29 and partly towards a further volume 28 of the puffer cylinder 5. Said further volume 28 is located on an opposite side of the piston 4 with respect to the portion 15 of the puffer volume 5 and is fluidly connected to an exhaust 29 arranged outside the wall structure 18 of the puffer unit 3 by at least one exhaust port 30. In this embodiment the least one exhaust port 30 comprises a plurality of sleeve-like exhaust ports that are evenly distributed in the circumferential direction with respect to the switching axis 11 at an opposite end 31 of the puffer cylinder 5 proximal to the arcing zone 13. Since the gas may move freely through the exhaust ports 30 if needed the direction of the gas flow at the exhaust ports 30 is indicated by double-headed arrows.

Figure 3:
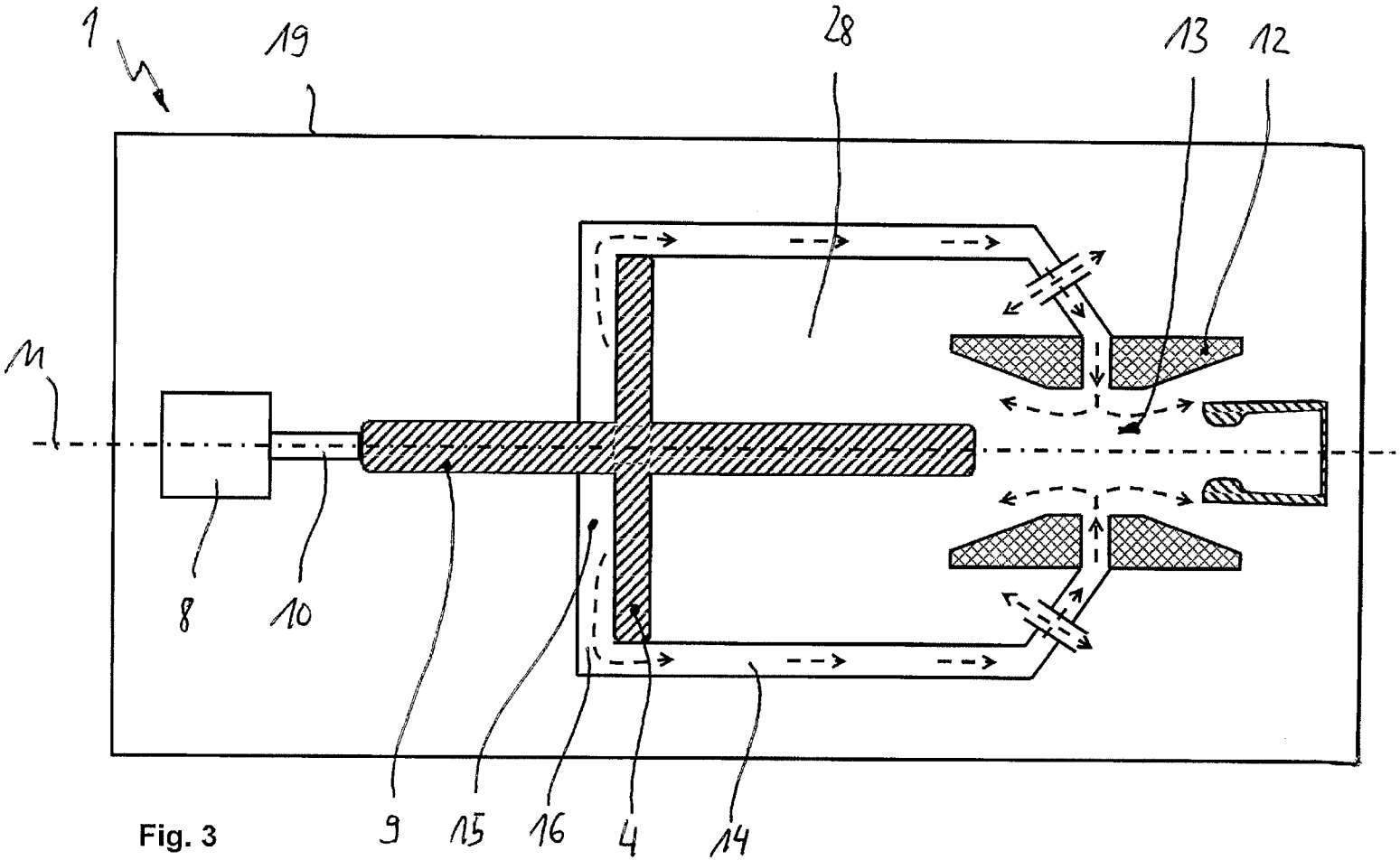
FIG. 3 a schematic longitudinal section through a first embodiment of the puffer breaker of FIG. 1, wherein the first contact member has just reached its second position.

In FIG. 3 the piston stem 9 with the first contact member 2 and the piston 4 are drawn again further to the left compared to 2 before the piston is brought to a halt. In this stage the first contact member 2 has just reached its second position. The arc interruption process has been concluded at the intermediate position of the first contact member 2 as shown in FIG. 2. FIG. 3 discloses that the dead volume consist of a disc-shaped remainder of the portion 5 of the puffer cylinder 15 and the gas channel 14.

While the minimal play in between the shell surface of the piston 4 and the interior side 34 of the puffer cylinder 5 allows for a sufficient sealing function during the fast acceleration of the puffer volume 6 against the further volume 28 even without providing conventional sealing gaskets the formation of a gas cushion in the terminal stage of the movement of the piston 4 may lead to an undesired amount of a back travel movement of the piston 4 towards its initial position shown in FIG. 1. The larger the acceleration the larger the back travel of the piston 4 becomes an issue because a movement of the piston to the right inevitably brings the first contact member 2 closer to the fixed second contact member 7. This is undesired as it promotes re-arcing which has to be avoided. Thus a good embodiment for preventing back travel of the piston is explained hereinafter.

Figure 4:
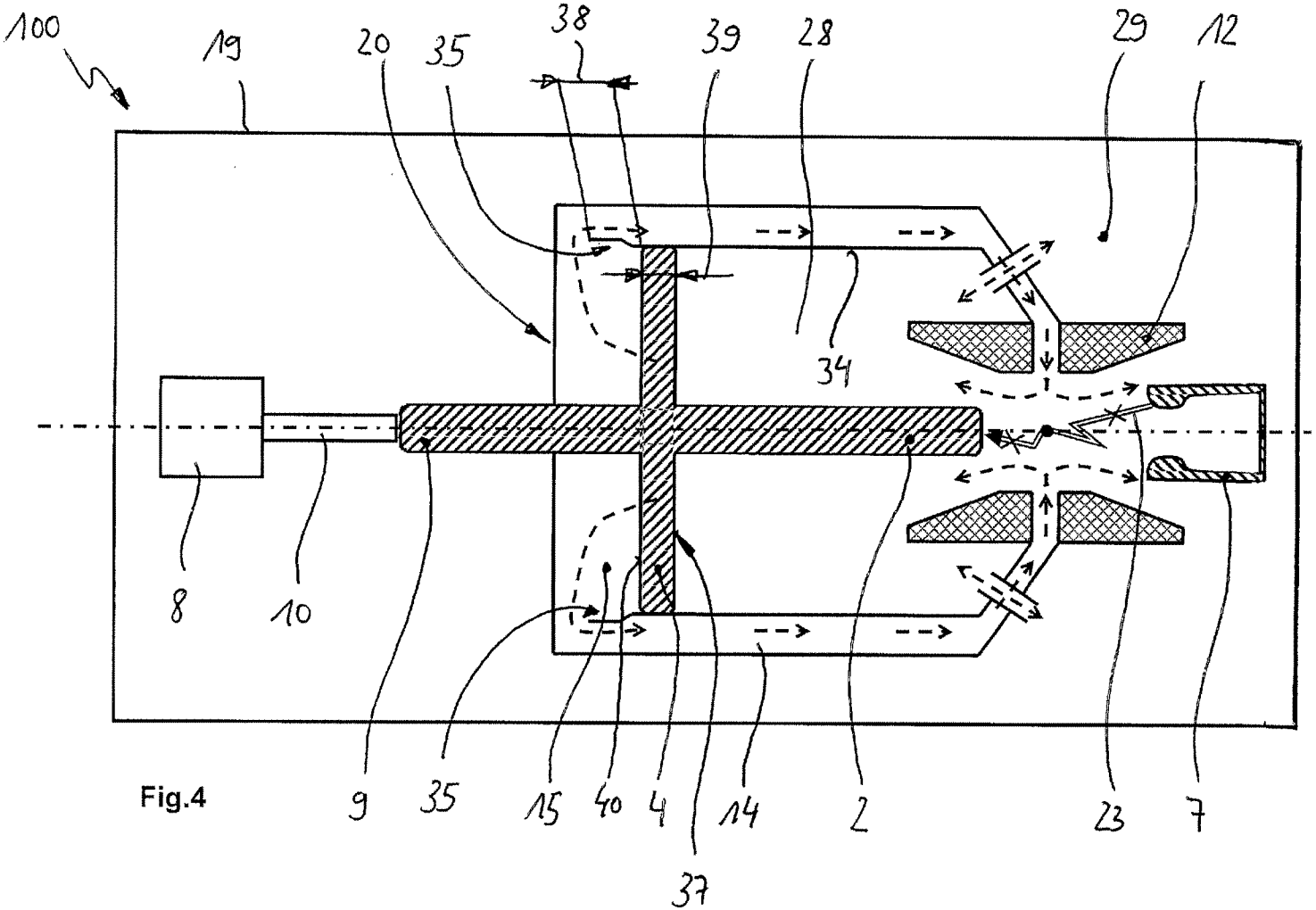
FIG. 4 a schematic longitudinal section through a second embodiment of the puffer breaker similar to FIG. 2, wherein the first contact member is in the same intermediate position between the first position and a second position.
Figure 5:
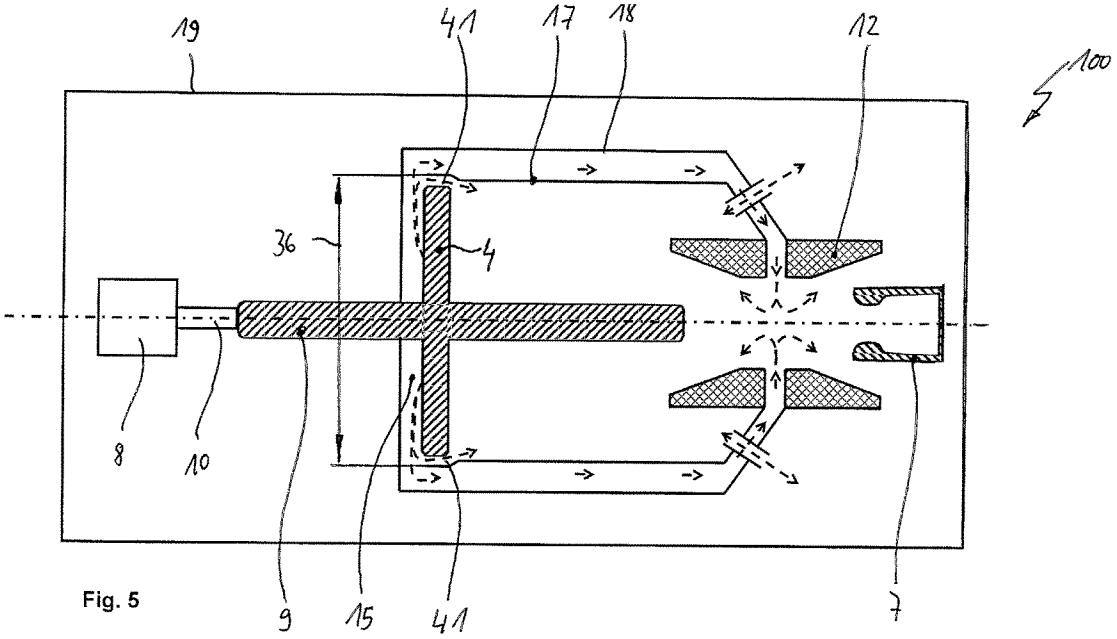
FIG. 5 a schematic longitudinal section through a second embodiment of the puffer breaker of FIG. 4, wherein the first contact member has just reached its second position.

A second embodiment of a puffer breaker 100 is described below with reference to FIGS. 4 and 5. Since the second embodiment of a puffer breaker 100 is similar to the first embodiment of a puffer breaker 1 described before, same or functionally identical elements are given the same reference numerals as in FIGS. 1 to 3. Below the focus is put on indicating the differences of the second embodiment of a puffer breaker 100 compared to the first embodiment of a puffer breaker 1.

The difference of the second embodiment 100 resides in the shape of the puffer unit 3 at the first end 20, especially the shape of an interior side 34 of the puffer cylinder 5 proximate to the port 16 comprising again a plurality of gas outlets leading from the portion 15 of the puffer cylinder 5 to the gas channel 14. An annular groove 35 (also referred to a radial widening) is arranged on an interior side 34 of the puffer cylinder wall 17 proximate to the port 16 such that a diameter 36 of the locally widened interior side 34 of the puffer cylinder 5 is larger than an outer diameter of the piston 4. Said annular groove 35 starts at about an axial position reached by a trailing end of the piston at the moment of current interruption in an operating state of the puffer breaker. In other words, the annular groove starts at about an axial position the trailing end 37 of the puffer piston 4 reaches when the first contact member 2 is approaching the second position. At that moment in time the arc interruption process in the arcing zone is concluded and having a maximal gas pressure at the nozzle is not required at that moment of interruption process any longer. Thus FIG. 4 corresponds functionally exactly to the situation of the interruption process explained with reference to FIG. 2. The position on the piston stem 9, the first contact member 2 and the piston 4 in FIG. 5 is the very same as shown and described in FIG. 3.

The annular groove 35 extends in the direction of the switching axis 11 over a distance 38 that is larger than a thickness 39 of the piston 4 proximate to the interior side 34 of the puffer cylinder 5. The annular groove 35 is dimensioned such that gas from the portion 5 of the puffer cylinder 6 at the leading end 40 of the puffer piston 4 is allowed to escape to the exhaust 29 via said annular groove 35 to a trailing end 37, i.e. the side of the piston 4 along an annular escape path 41 when the first contact member is approaching the second position. That way the energy of the gas trapped in the dead volume 6 can escape easily because an overall gas resistance in the escape path 41 is designed such that it is smaller than an overall gas resistance in the gas channel 14 at this position of the piston 4 in an operating state of the puffer breaker 100. As a result the pressure in the whole dead volume 6 can be released faster due to the additional outflow cross-section formed by the annular groove 35.

As a result the back travel of the piston in the puffer cylinder can be prevented or at lowered to a minimum such that the risk of a re-arcing can be avoided.

Compared to the first embodiment 1 the diameter of the wall structure 18 of the puffer unit 3 of the second embodiment 100 has been widened for ensuring that the smallest cross-section of the gas channel 14 is still at the nozzle 12 and not at a constriction caused by the radially outwardly bulge of the puffer cylinder wall 17.

Figure 6:
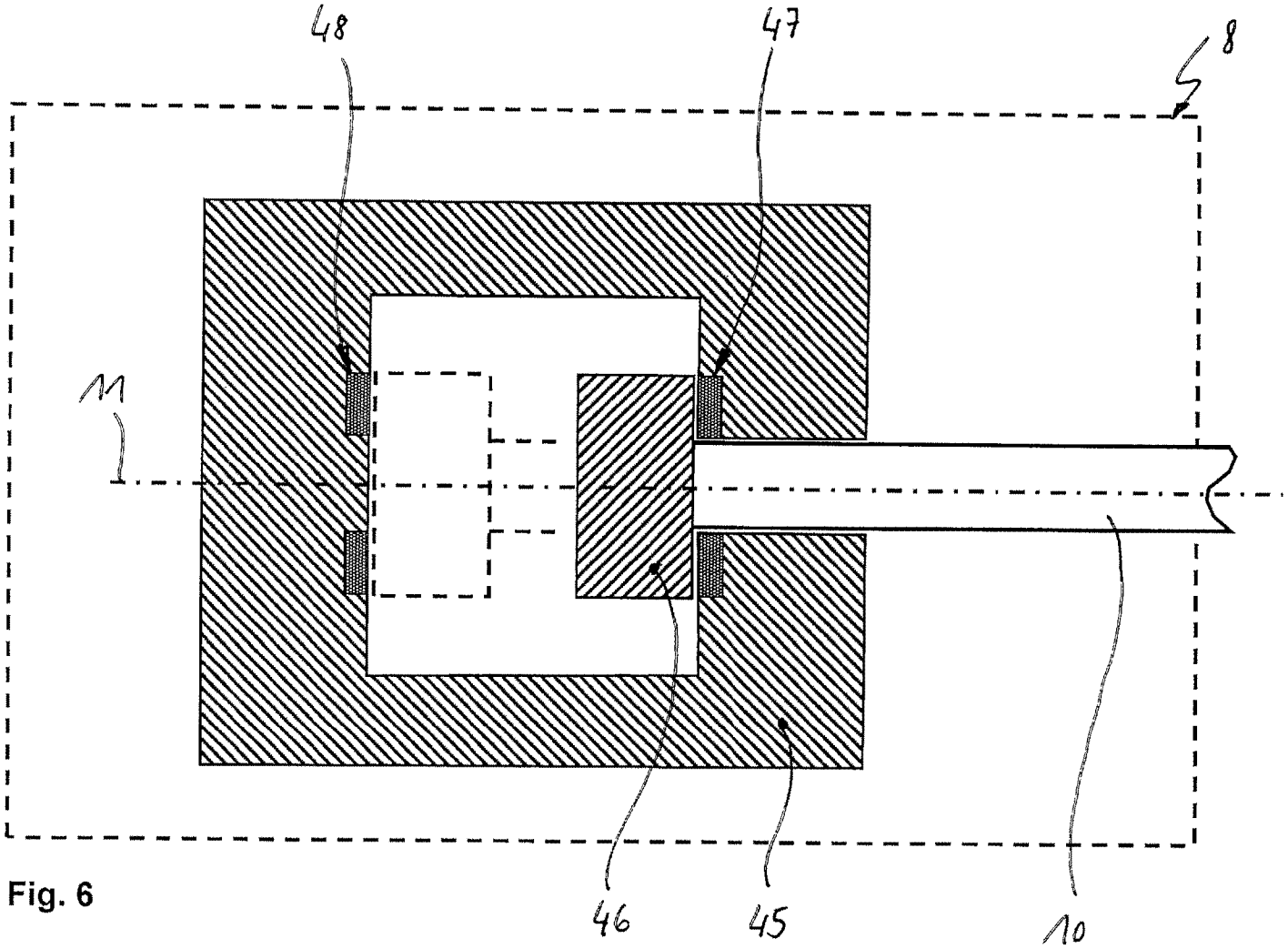
FIG. 6 an embodiment of a drive for driving a piston unit via a pull rod by means of an electromagnetic repulsive force.

FIG. 6 illustrates an embodiment of a drive 8 for driving a piston unit of a puffer unit 3 via the pull rod 10 by means of an electromagnetic repulsive force caused by the drive 8. FIG. 6 shows a portion of the pull rod 10 and a schematic close-up of the drives shown in FIGS. 1-5. In said FIGS. 1-5 the pull rod 10 has been drawn to have different lengths depending to their position relative to the switching axis. Since the drive chain of the embodiments of the present application are linear and rigid the length of the pull rod will not vary and remain constant instead. Thus the simplification in FIGS. 1-5 shall be excused.

FIG. 6 shows a longitudinal cross-section through an electromagnetic repulsive drive 8 also known as Thomson coil drive. Said drive 8 has a piston chamber 45 with a drive piston 46 shown in a position corresponding to the position the first contact member has in its first position. The drive piston 46 is connected to the pull rod 10.

The electromagnetic repulsive drive 8 has a first drive coil 47 and a second drive coil 48. Once the first drive coil 47 is activated the drive piston 46 is accelerated very quick and moved to the left causing the first contact member 2 of the puffer unit 3 to leave its first position and to move to its second position. A bistable suspension or the like (not shown in FIG. 6) may assist the drive piston 46 in remaining at two predefined static positions only.

The second drive coil 48 is activated for moving the drive piston 46 and thus the first contact member 2 back to its initial first position. The drive piston 46 is shown in its initial first piston in FIG. 6 whereas the contour when in its second position is indicated by dashed lines proximate to the second drive coil.

LIST OF REFERENCE NUMERALS

1, 100 Puffer breaker
2 First contact member
3 Puffer unit
4 Piston
5 Puffer cylinder
6 Puffer volume
7 Second contact member
8 drive
9 piston stem
10 pull rod
11 switching axis
12 gas nozzle
13 arcing zone
14 gas channel
15 portion of the puffer cylinder
16 port
17 puffer cylinder wall
18 wall structure
19 gas tight enclosure
20 first end of the puffer volume/puffer cylinder
23 electric arc
24 gas flow
25 stagnation point
26 axial interruption point
27 axial interruption point
28 further volume
29 exhaust
30 exhaust port
31 opposite end of puffer cylinder
34 interior wall side of puffer cylinder wall 17
35 annular groove
36 diameter of the interior wall at the groove 35
37 trailing end of the puffer piston (when opening)
38 distance
39 thickness of piston
40 leading end of the puffer piston (when opening)
41 escape path
45 piston chamber
46 drive piston
47 first drive coil
48 second drive coil

The invention claimed is:

1. Gas-insulated high voltage puffer breaker, comprising
a puffer unit with a piston that is movably arranged in a puffer cylinder such that a puffer volume is delimited,
a first contact member being movably arranged relative to a second contact member of the circuit breaker such that a current path is established in a first position where the first contact member is contacting the second contact member and that said current path is interrupted in an arcing zone once the first contact member is moved to a second position where the first contact member is opened from the second contact member, wherein the first contact member is connected to a drive by a piston stem,
and a nozzle for circumferentially delimiting the arcing zone of the puffer breaker,
wherein
the piston and the first contact member are attached to the piston stem,
and wherein the puffer volume comprises the gas channel as well as a portion of the puffer cylinder, wherein the gas channel and said portion of the puffer cylinder are fluidly connected to one another by a port such that a gas flowing in a first direction from the portion of the puffer cylinder is redirected via the gas channel in a second direction towards the nozzle once the first contact member is moved from the first position towards the second position,
and wherein the gas channel is provided radially outside of the puffer cylinder between a puffer cylinder wall delimiting the puffer cylinder and a wall structure of the puffer unit.

2. The high voltage puffer breaker according to claim 1, wherein the first contact member and the piston stem are movably arranged such that they are movable along a switching axis, in particular along a linear switching axis.

3. The high voltage puffer breaker according to claim 1, wherein the portion of the puffer cylinder is arranged rotationally symmetric with respect to the switching axis, wherein the puffer volume in the portion of the puffer cylinder is delimited radially inwards with respect to the switching axis by the piston stem.

4. The high voltage puffer breaker according to claim 1, wherein the gas channel is arranged in between the puffer cylinder wall and the wall structure of the puffer unit such that a annular radial gap is formed.

5. The high voltage puffer breaker according to claim 1, wherein the gas channel is stationary with respect to the arcing zone.

6. The high voltage puffer breaker according to claim 4, wherein an overall cross section of the annular radial gap is smallest at an end of the gas channel discharging into the nozzle.

7. The high voltage puffer breaker according to claim 1, wherein the port is arranged at a remote first end of the puffer cylinder with respect to the arcing zone.

8. The high voltage puffer breaker according to claim 1, wherein the port is arranged in the puffer cylinder wall extending circumferentially about the portion of the puffer cylinder with respect to the switching axis.

9. The high voltage puffer breaker according to claim 1, wherein the port comprises a plurality of gas outlets leading from the portion of the puffer cylinder to the gas channel.

10. The high voltage puffer breaker according to claim 1, wherein a further volume of the puffer cylinder is located on an opposite side of the piston with regards to the portion of the puffer cylinder and is fluidly connected to an exhaust arranged outside the wall structure of the puffer unit by at least one exhaust port.

11. The high voltage puffer breaker according to claim 1, wherein the piston is dimensioned relative to the portion of the puffer cylinder such that no bodily radial seal element in between the piston and the interior side of the puffer cylinder wall is required.

12. The high voltage puffer breaker according to claim 1, wherein an annular groove is arranged on an interior side of the puffer cylinder wall adjacent to the port such that a diameter of the interior side of the puffer cylinder is larger than an outer diameter of the piston, wherein the annular groove starts at about an axial position reached by a trailing end of the piston when the first contact member is approaching the second position in an operating state of the puffer breaker, and wherein the annular groove extends in the direction of the switching axis over a distance being larger than a thickness of the piston at the inside wall of the puffer cylinder, and wherein the annular groove is dimensioned such that gas from the portion of the puffer cylinder is allowed to escape to the exhaust via said annular groove to a rear side of the piston along an escape path when the first contact member is approaching the second position.

13. The high voltage puffer breaker according to claim 1, wherein an electromagnetic repulsive force can be produced by the Thomson coil drive for moving the piston stem.

14. The high voltage puffer breaker according to claim 1, wherein at least one of the piston and the first contact member are at least partially integrated into the piston stem.

15. The high voltage puffer breaker according to claim 1, wherein the puffer unit is arranged in a gas-tight enclosure, and in that the drive is connected to the piston stem by a pull rod, wherein the drive and the pull rod are located in the same gas-tight enclosure as the puffer unit, too.

16. A breaker unit comprising a vacuum interrupter that is electrically connected in series to a high-voltage puffer breaker comprising:

a puffer unit with a piston that is movably arranged in a puffer cylinder such that a puffer volume is delimited, a first contact member being movably arranged relative to a second contact member of the circuit breaker such that a current path is established in a first position where the first contact member is contacting the second contact member and that said current path is interrupted in an arcing zone once the first contact member is moved to a second position where the first contact member is opened from the second contact member, wherein the first contact member is connected to a drive by a piston stem, and a nozzle for circumferentially delimiting the arcing zone of the puffer breaker, wherein the puffer volume is fluidly connected to the nozzle by a gas channel, wherein the piston and the first contact member are attached to the piston stem, and wherein the puffer volume comprises the gas channel as well as a portion of the puffer cylinder, wherein the gas channel and said portion of the puffer cylinder are fluidly connected to one another by a port such that a gas flowing in a first direction from the portion of the puffer cylinder is redirected via the gas channel in a second direction towards the nozzle once the first contact member is moved from the first position towards the second position, and wherein the gas channel is provided radially outside of the puffer cylinder between a puffer cylinder wall delimiting the puffer cylinder and a wall structure of the puffer unit.

17. The circuit breaker unit, according to claim 16, wherein the vacuum interrupter comprises a further drive, wherein a further electromagnetic repulsive force can be produced by said further drive for moving a movable contact member of the vacuum interrupter.

18. The circuit breaker unit, according to claim 16, wherein the movable contact member of the vacuum interrupter can be moved by the same drive as the first contact member of the puffer breaker.

19. A combination, comprising:

a HVDC system and a circuit breaker unit comprising a vacuum interrupter that is electrically connected in series to a high-voltage puffer breaker comprising:

a puffer unit with a piston that is movably arranged in a puffer cylinder such that a puffer volume is delimited, a first contact member being movably arranged relative to a second contact member of the circuit breaker such that a current path is established in a first position where the first contact member is contacting the second contact member and that said current path is interrupted in an arcing zone once the first contact member is moved to a second position where the first contact member is opened from the second contact member, wherein the first contact member is connected to a drive by a piston stem, and a nozzle for circumferentially delimiting the arcing zone of the puffer breaker, wherein the puffer volume is fluidly connected to the nozzle by a gas channel, wherein the piston and the first contact member are attached to the piston stem, and wherein the puffer volume comprises the gas channel as well as a portion of the puffer cylinder, wherein the gas channel and said portion of the puffer cylinder are fluidly connected to one another by a port such that a gas flowing in a first direction from the portion of the puffer cylinder is redirected via the gas channel in a second direction towards the nozzle once the first contact member is moved from the first position towards the second position, and wherein the gas channel is provided radially outside of the puffer cylinder between a puffer cylinder wall delimiting the puffer cylinder and a wall structure of the puffer unit.

* * * * *